United States Patent [19]

Bottemiller

[11] Patent Number: 4,786,106

[45] Date of Patent: Nov. 22, 1988

[54] ROCKING CHAIR CONSTRUCTION AND METHOD OF MAKING SAME

[75] Inventor: Donald L. Bottemiller, Wadena, Minn.

[73] Assignee: Homecrest Industries Incorporated, Wadena, Minn.

[21] Appl. No.: 48,598

[22] Filed: May 11, 1987

[51] Int. Cl.[4] ..... A47C 3/025

[52] U.S. Cl. ..... 297/265; 248/576; 297/302; 403/362

[58] Field of Search ..... 297/265, 293, 302, 304; 403/104, 362; 248/575, 576, 608

[56] References Cited

U.S. PATENT DOCUMENTS

| | | | |
|---|---|---|---|
| 329,850 | 11/1885 | Overman . | |
| 501,918 | 7/1893 | Caldwell | 403/298 |
| 1,431,612 | 10/1922 | Wittner | 403/362 X |
| 1,989,203 | 1/1933 | Larsen . | |
| 1,995,420 | 3/1935 | Fischer | 403/362 X |
| 2,063,781 | 12/1936 | Ball . | |
| 2,071,084 | 2/1937 | Nolan . | |
| 2,083,716 | 6/1937 | Klar . | |
| 2,283,755 | 5/1942 | Mies . | |
| 2,880,021 | 3/1959 | White . | |
| 2,916,084 | 12/1959 | Bottemiller et al. | 248/425 X |
| 2,974,719 | 3/1961 | McClellan . | |
| 2,981,315 | 4/1961 | Schaffer . | |
| 3,026,143 | 3/1962 | Kundtz et al. | 297/258 |
| 3,070,343 | 12/1962 | Gariepy | 297/302 X |
| 3,072,435 | 1/1963 | Komulainen | 297/258 |
| 4,371,142 | 2/1983 | Bottemiller et al. | 248/573 |
| 4,411,468 | 10/1983 | Apissomian | 297/264 |

*Primary Examiner*—Kenneth J. Dorner
*Assistant Examiner*—Peter R. Brown
*Attorney, Agent, or Firm*—Kinney & Lange

[57] ABSTRACT

A rocking chair has an aluminum frame chair portion that is mounted to a base by a pair of coil springs that provide rocking action to the chair. The springs are fixedly attached to the base and each spring has an outwardly extending portion that is attached to the seat portion by extending into a passage of the chair portion. The outwardly extending portion has a notch, and a set screw extends into the passage engaging the notch to retain the portion within the passage, preventing the possibility of the chair portion becoming separated from the base.

3 Claims, 2 Drawing Sheets

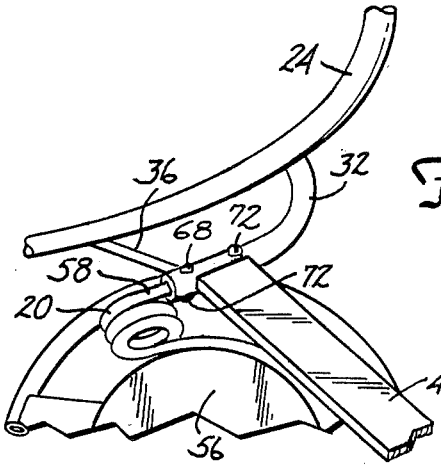
Fig. 3
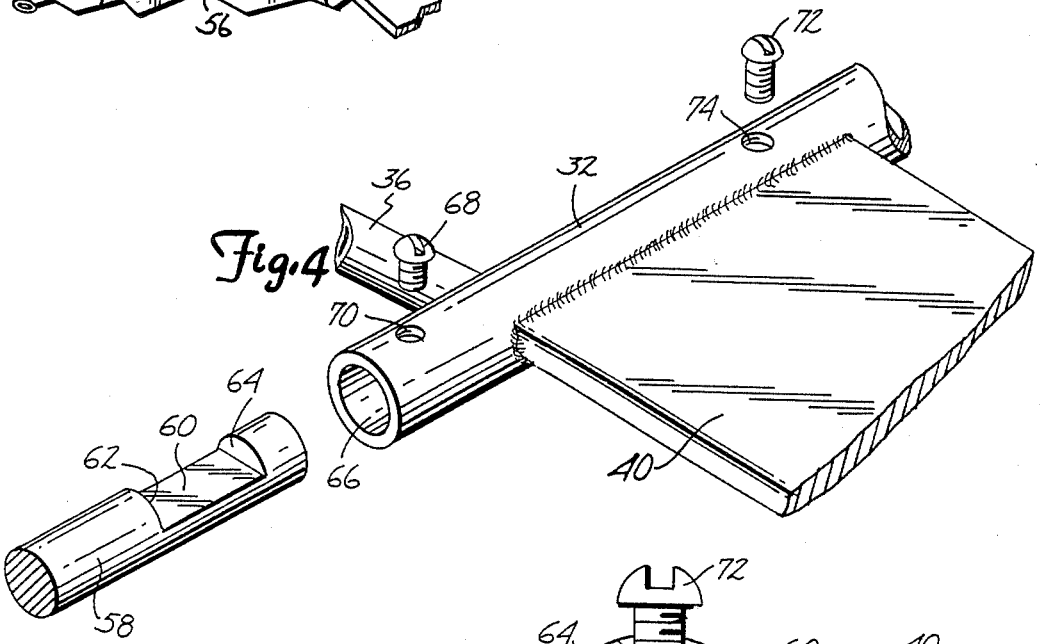
Fig. 4
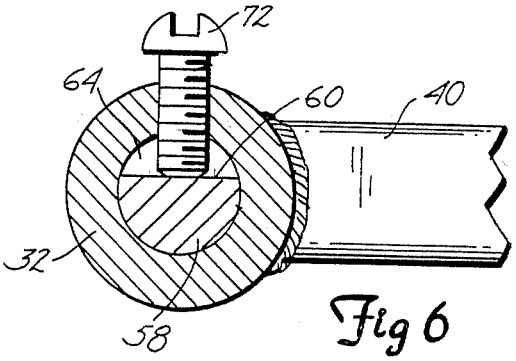
Fig 6
Fig. 5
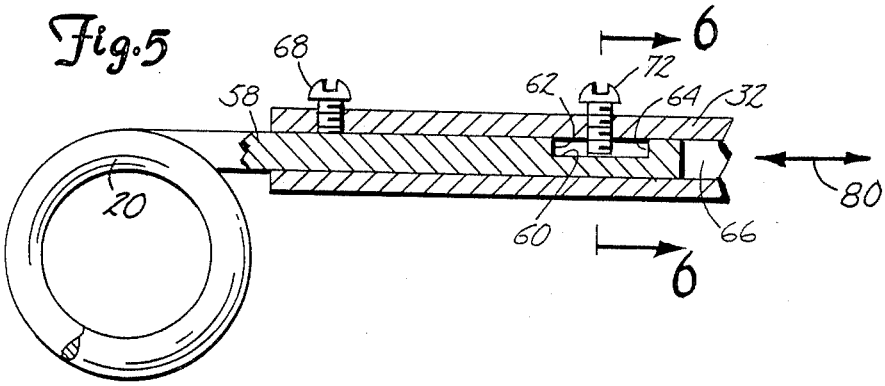

ROCKING CHAIR CONSTRUCTION AND METHOD OF MAKING SAME

BACKGROUND OF THE INVENTION

1. Field of the Invention

The present invention relates to rocking chair constructions. In particular, it relates to a rocking chair construction made of both steel and aluminum.

2. Description of the Prior Art

Rocking chairs having a stationary base have been known for quite some time. A rocking mechanism is provided to allow the chair to rock with respect to the base. Examples of such rocking chairs are illustrated in the Bottemiller et al U.S. Pat. No. 2,916,084, the Apissomian U.S. Pat. No. 4,411,468 and the Bottemiller et al U.S. Pat. No. 4,371,142, all assigned to the same assignee as the present application.

One rocking mechanism that is often used is a pair of coil springs, such as is described in the Bottemiller et al U.S. Pat. No. 2,916,084. The rocking chairs described in the above-mentioned patents are entirely made of steel tubing and are very durable. Although such rocking chairs have been highly successful commercially, they are quite heavy due to the entire steel construction. It has been proposed that a lighter weight rocking chair, having the same rocking action as a steel rocking chair, would be very desirable.

SUMMARY OF THE INVENTION

The present invention includes a method of making a rocking chair having a pair of substantially parallel steel coil springs that supply a rocking action to the chair. The method includes providing a chair frame structure made of aluminum or an aluminum alloy, with the chair frame structure having a pair of tubular ends disposed proximate a lower portion thereof. A base is provided having a pair of substantially parallel steel coil springs mounted thereon. Each coil spring has an outwardly extending portion that is inserted into a passage of a tubular end and is retained in the passage by extending a pin means through the tubular end to engage a notch of the outwardly extending portion of the coil spring.

The present invention also includes a chair construction having a seat portion made of an aluminum framework and a stationary ground-engaging base attached to the aluminum framework by a pair of coil springs fixedly attached to the base. Each coil spring has an outwardly extending portion having a notch. The outwardly extending portion extends into a passage of the framework and set screw means extends through the passage engaging the notch to retain the portion within the passage.

BRIEF DESCRIPTION OF THE DRAWINGS

FIG. 3 is a perspective view of a portion of the bottom of the chair construction.

FIG. 4 is an exploded perspective view of the manner in which the coil springs are attached to the chair portion of the present invention.

FIG. 5 is a side view of the spring attachment to the chair portion with a portion shown in cross-section.

FIG. 6 is a cross-sectional view taken along the line 6—6 in FIG. 5.

DETAILED DESCRIPTION OF THE PREFERRED EMBODIMENTS

Figure 1:
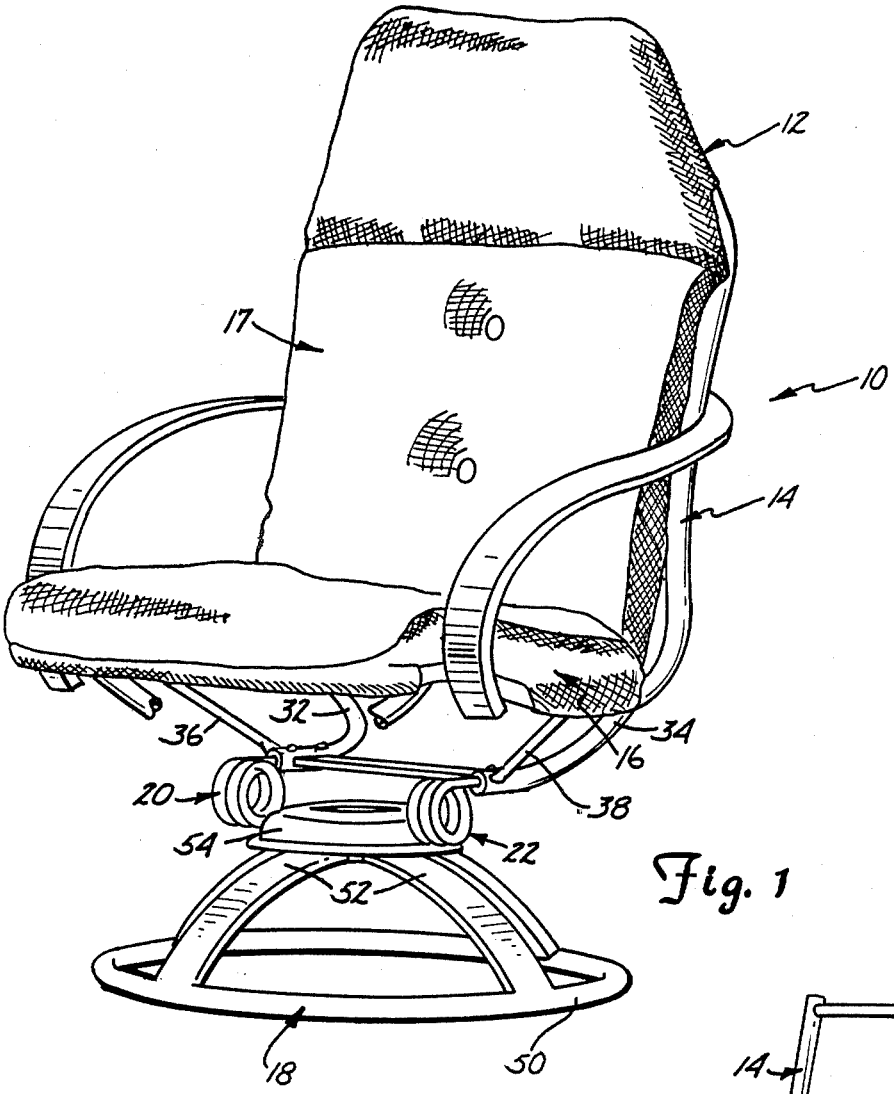
FIG. 1 is a perspective view of the chair construction of the present invention.

A chair construction of the present invention is generally indicated at 10 in FIG. 1. The chair construction includes a chair portion 12 having a back portion 14 and a seat portion 16. A cushion 17 is disposed on the chair portion 12 and preferably rests on plastic or fabric straps (not shown) which are strung on the chair portion 12 in a manner that is well known. A pair of substantially parallel coil springs 20 and 22 attach the chair portion to a base 18 and provide rocking action to the chair.

The chair portion 12 is made of aluminum or an aluminum alloy providing a lightweight construction that is corrosion resistant to the elements. The base 18 is also preferably made of an aluminum or an aluminum alloy for corrosion resistance. Alternatively, the base may be made of steel to add weight to the chair for stabilizing the chair during rocking. The coil springs 20 and 22 are made of steel since steel provides the type of rocking action desirable in a rocking chair. The combination of an aluminum or aluminum alloy chair portion 12 and a base 18 with steel coil springs provides a rocking chair construction that is both durable and corrosion resistant while providing a desired rocking action.

Figure 2:
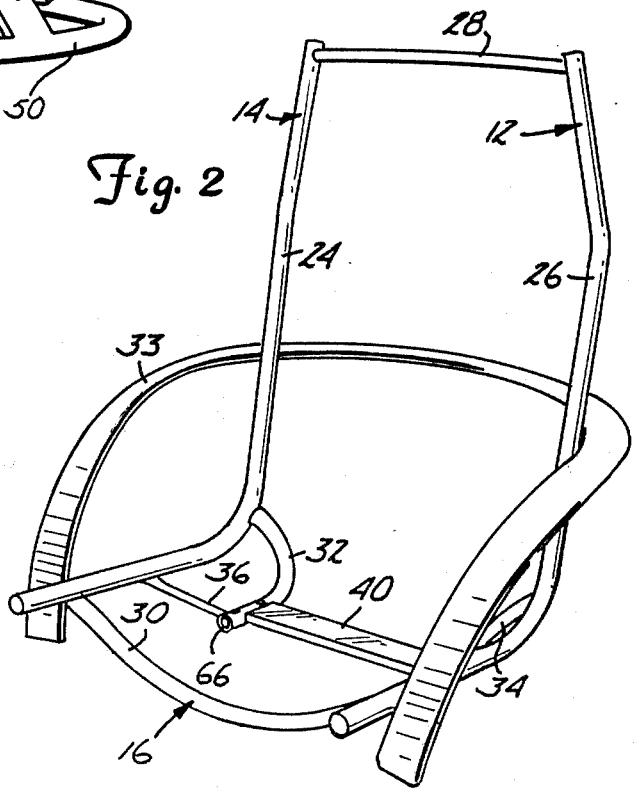
FIG. 2 is a perspective view of the chair portion.

Referring to FIG. 2, the chair portion 12 is made of an aluminum or aluminum alloy tubular frame. The back portion 14 includes a pair of upwardly extending tubular members 24 and 26 that are joined at a top end by a tubular member 28. The tubular members 24 and 26 extend downwardly and bend horizontally to form part of the seat portion 16 by being connected with a horizontal tubular member 30. An arm rest made of a unitary piece of aluminum is bent in a manner that wraps around the chair portion 12 and is welded thereto. The configuration of the chair portion is not of particular importance to the present invention except for the manner in which the chair portion is attached to the base.

The chair portion 12 further includes tubular connecting members 32 and 34 which are welded to the members 24 and 26, respectively, at one end and each have free ends with passages 66. The member 32 is further braced by a bracing member 36 and the member 34 is also braced by a bracing member 38. The members 32 and 34 are further braced by a cross member 40 that is welded at both ends to the members 32 and 34. The members 32 and 34 are made of a heavy wall aluminum tube having a wall thickness of, for example, 0.090 inches.

Referring back to FIG. 1, the base 18 in the preferred form illustrated, has a circular ground-engaging bottom 50 with upwardly and radially extending curved bars 52 joined to a centrally disposed disk-configured member 54. As can easily be seen from FIG. 1, the member 54 is disposed above the ground-engaging member 50 at a height that positions the chair portion 12 conveniently for sitting.

Springs 20 and 22 are of a similar construction and will be described with reference to the coil spring 20 illustrated in FIGS. 3–6. Each coil spring is attached to the disk member 54 at a curved portion 56 that curves around the perimeter of the disk member 54. If the disk member is made of steel, then the curved portion is welded to the disk member 54. If the base is made of aluminum or an aluminum alloy, then the curved portion is attached by a suitable fastener such as a screw.

In addition, each coil spring has an outwardly extending member 58. The members 58 are in substantial parallel relationship with each other and extend substantially horizontally from the coil spring. Each member 58 has a notch 60 located proximate an end thereof. The notch 60 has shoulders 62 and 64. Preferably, the diameter of the member 58 is substantially equal to or just slightly smaller than the diameter of the passage 66 of the member 32.

The member 58 is positioned within the passage 66, attaching the base 18 to the chair portion 12. A first set screw 68 threadably engages a threaded hole 70 within the member 32. The set screw 68 is threaded into the hole 70 such that an end contacts the portion 58 frictionally engaging the member 58 against the surfaces of the passage 66 to retain the member 58 within the passage. The first set screw 68 acts as a member to keep the base 18 and the chair portion secured to each other.

A second set screw 72 engages a second threaded aperature 74 within the member 32 at a position to engage the slot 60 of the member 58. The engagement of the slot by the set screw 72 serves two functions. First, engaging the slot 60 ensures that the member 58 will not slip out of the passage 66 if the set screws 68 and 72 are loosened. Second, the slot 60 permits movement of the member 58 along the passage 66 in a direction indicated by arrow 80 such that the rocking action of the chair is adjusted. Moving the member 58 out of the passage 66 provides a softer rocking action. Moving the member 58 further into the passage 66 provides for a stiffer rocking action. The member may be moved over the entire length of the notch 60 with the length of travel being defined when the set screw 68 engages either shoulder 62 or 64.

In one working embodiment, the notch is approximately one inch long and when the set screws are loosened, the member 58 is slid along the member 32 in a direction indicated by arrow 80 in FIG. 5, adjusting the relative stiffness of the rocking action as described herein. To secure the selected stiffness of rocking action, the set screws 68 and 72 are then tightened. It should be understood that positioning a chair portion along an outwardly extending member of a spring to adjust the stiffness of the rocking action is old, having been disclosed in the Bottemiller U.S. Pat. No. 2,916,084. However, the manner in which the member 32 is securely held with respect to the member 58 while still permitting adjustment of the rocking action is neither taught or suggested in the Bottemiller U.S. Pat. No. 2,916,084. Pushing the member 32 towards the spring 20 provides for a stiffer rocking action while moving the member 32 away from the spring 20 provides for a softer rock.

Furthermore, the method of the present invention in assembling the chair construction provides for the transition in chair construction of one material to another, such as steel to aluminum, allowing each material to be utilized for what it is best suited. The aluminum of aluminum alloy is used in the chair portion and throughout much of the base to provide lightweight construction that is corrosion resistant. The steel coil springs provide comfortable rocking action to the rocking chair construction.

Although the present invention has been described with reference to preferred embodiments, workers skilled in the art will recognize that changes may be made in form and detail without departing from the spirit and scope of the invention.

What is claimed is:

1. An improved rocking chair construction having a seat portion, a ground-engaging base and a pair of coil springs attaching the base to the chair portion and for providing rocking action to the chair, the improvement comprising:

the chair portion having at least two tubular ends disposed proximate a lower portion thereof, each tubular end having a passage;

each coil spring having an outwardly-extending member having a diameter equal to or substantially less than the passage and extending into one of the passages, each outwardly-extending member having a notch defined by first and second spaced axially apart shoulders; and first and second set screws threadably engaging each tubular end, the first set screw having an end portion disposed between the first and second spaced axially apart shoulders for engagement of the shoulders to define the axial travel of the tubular end portions with respect to the outwardly-extending member of the coil springs, and the second set screw having an end frictionally engaging the coil spring to retain the coil spring in a fixed position with respect to the tubular member.

2. The chair construction of claim 1 wherein the chair portion is made of aluminum or an aluminum alloy and the coil springs are made of steel.

3. The chair construction of claim 2 wherein each tubular end has a wall thickness of approximately 0.0900 inches.

* * * * *